US010734741B2

(12) United States Patent
Yukutake et al.

(10) Patent No.: US 10,734,741 B2
(45) Date of Patent: Aug. 4, 2020

(54) CONNECTOR

(71) Applicant: IRISO ELECTRONICS CO., LTD., Yokohama-shi, Kanagawa (JP)

(72) Inventors: Hiroaki Yukutake, Yokohama (JP); Yoshihito Ohkuma, Yokohama (JP); Hitoshi Suzuki, Yokohama (JP)

(73) Assignee: IRISO ELECTRONICS CO., LTD., Yokohama-Shi, Kanagawa (JP)

( * ) Notice: Subject to any disclaimer, the term of this patent is extended or adjusted under 35 U.S.C. 154(b) by 0 days.

(21) Appl. No.: 16/380,369

(22) Filed: Apr. 10, 2019

(65) Prior Publication Data

US 2019/0319382 A1 Oct. 17, 2019

(30) Foreign Application Priority Data

Apr. 17, 2018 (JP) ..... 2018-079201

(51) Int. Cl.
*H01R 12/71* (2011.01)
*H01R 12/70* (2011.01)
(Continued)

(52) U.S. Cl.
CPC ..... *H01R 12/716* (2013.01); *H01R 12/7005* (2013.01); *H01R 12/73* (2013.01);
(Continued)

(58) Field of Classification Search
CPC .. H01R 12/716; H01R 12/7005; H01R 12/73; H01R 13/405
(Continued)

(56) References Cited

U.S. PATENT DOCUMENTS 6,250,935 B1 * 6/2001 Mochizuki ..... H01R 13/658 439/74
7,059,908 B2 6/2006 Yamaguchi
(Continued)

FOREIGN PATENT DOCUMENTS

CN 201060978 Y 5/2008
EP 1 628 369 A1 2/2006
(Continued)

OTHER PUBLICATIONS

Extended European search report for European Patent Application No. 19168569.2, dated Sep. 11, 2019, 16 pages.

*Primary Examiner* — Alexander Gilman
(74) *Attorney, Agent, or Firm* — Westman, Champlin & Koehler, P.A.

(57) ABSTRACT

A connector includes a housing and a shield member. The housing includes an insertion-removal section and a guide face, a connection target is inserted into or removed from the insertion-removal section through an insertion-removal port in an insertion-removal direction, and the guide face is formed at a peripheral portion of the insertion-removal section so as to guide the connection target toward the insertion-removal section. The shield member includes a pair of shield portions and a coupling portion. The pair of shield portions are disposed on both sides of the housing in a first direction intersecting the insertion-removal direction, the coupling portion couples the pair of shield portions together in the first direction, the coupling portion contacts a location of the housing on an opposite side to the insertion-removal port in the insertion-removal direction, and the coupling portion at least partially overlaps the guide face as viewed in the insertion-removal direction.

7 Claims, 14 Drawing Sheets

(51) Int. Cl.
*H01R 12/73* (2011.01)
*H01R 13/405* (2006.01)
*H01R 13/6582* (2011.01)
*H01R 13/6587* (2011.01)

(52) U.S. Cl.
CPC ..... *H01R 13/405* (2013.01); *H01R 13/6582* (2013.01); *H01R 13/6587* (2013.01)

(58) Field of Classification Search
USPC ..... 439/660
See application file for complete search history.

(56) References Cited

U.S. PATENT DOCUMENTS 8,348,701 B1 * 1/2013 Lan ..... H01R 12/707 439/607.19
8,986,027 B2 * 3/2015 Nishimura ..... H01R 12/707 439/181
9,039,428 B2 * 5/2015 Sasaki ..... H01R 12/716 439/74
9,124,011 B2 * 9/2015 Miyazaki ..... H01R 12/716
9,728,882 B1 * 8/2017 Nakazawa ..... H01R 12/716
10,312,639 B2 * 6/2019 Chen ..... H01R 12/707
10,446,985 B2 * 10/2019 Ooi ..... H01R 12/716
10,498,055 B2 * 12/2019 Chen ..... H01R 12/73
10,505,300 B2 * 12/2019 Chen ..... H01R 12/7005
2005/0032400 A1 * 2/2005 Zhang ..... H01R 13/41 439/74
2005/0032434 A1 * 2/2005 Zhang ..... H01R 12/716 439/660
2005/0042924 A1 * 2/2005 Zhang ..... H01R 13/6582 439/607.36
2005/0095881 A1 * 5/2005 Fan ..... H01R 12/716 439/74
2005/0277334 A1 * 12/2005 Huang ..... H01R 23/6873 439/607.01
2006/0040557 A1 * 2/2006 Yamaguchi ..... H01R 13/6583 439/607.17
2006/0052008 A1 * 3/2006 Pan ..... H01R 12/716 439/660
2017/0033505 A1 * 2/2017 Ozeki ..... H01R 13/6594

FOREIGN PATENT DOCUMENTS

EP 1 684 387 A1 7/2006
JP 2012-252785 A 12/2012
JP 2016-9619 A 1/2016

* cited by examiner

CONNECTOR

CROSS-REFERENCE TO RELATED APPLICATION

This application claims priority under 35 USC 119 from Japanese Patent Application No. 2018-079201 filed Apr. 17, 2018, the disclosure of which is incorporated by reference herein in its entirety.

BACKGROUND

Technical Field

The present disclosure relates to a connector.

Related Art

In Japanese Patent Application Laid-Open (JP-A) No. 2016-9619, a first connector includes a first housing that fits together with a second connector, plural first terminals that form an electrical connection with second terminals of the second connector, a pair of first reinforcing metal fittings, and a pair of shield plate portions. The pair of first reinforcing metal fittings include outer side connection portions that cover a pair of end faces of the first housing.

SUMMARY

In the connector of JP-A No. 2016-9619, length direction end portions of the first housing are covered from a side closer to the second connector by outer side connection portions. Thus, if a guide face to guide the second connector is formed at the length direction end portions of the first housing, the outer side connection portions are disposed further toward outer sides from the guide face so as not to cover the guide face.

However, if the outer side connection portions are disposed further toward the outer sides from the guide face, the first housing needs to be extended in the length direction in order to support the outer side connection portions, thereby increasing the size of the connector. Namely, there is room for improvement both in guiding a connection target and in suppressing an increase in the size of the housing of connectors in which a shield member is provided at a housing.

An object of the present disclosure is to provide a connector in which a shield member is provided at a housing of the connector, capable of both guiding a connection target and suppressing an increase in the size of the housing.

A connector according to a first aspect of the present disclosure includes a housing and a shield member. The housing includes an insertion-removal section and a guide face. The connection target, from an insertion-removal portion side of the connection target, is inserted into or removed from the insertion-removal section through an insertion-removal port in an insertion-removal direction. The guide face formed at a peripheral portion of the insertion-removal section such that the guide face is configured to guide the connection target toward the insertion-removal section. The shield member includes a pair of shield portions and a coupling portion. The pair of shield portions are disposed on both sides of the housing in a first direction intersecting the insertion-removal direction so as to suppress propagation of electromagnetic waves. The coupling portion couples the pair of shield portions together in the first direction intersecting the insertion-removal direction. The coupling portion contacts a location of the housing on an opposite side to the insertion-removal port in the insertion-removal direction, and the coupling portion is disposed so as to at least partially overlap the guide face as viewed in the insertion-removal direction.

In the connector according to the first aspect, the coupling portion of the shield member contacts the location of the housing on the opposite side to the insertion-removal port in the insertion-removal direction, such that the coupling portion is not disposed on the insertion-removal port side of the housing. There is accordingly no need to set a placement space for the coupling portion so as to be offset toward an outer side with respect to the guide face. Moreover, the coupling portion is disposed so as to at least partially overlap the guide face as viewed in the insertion-removal direction. This suppresses an increase in the length of the housing compared to configurations in which the guide face and the coupling portion are disposed so as not to overlap each other. The connector according to the first aspect is thus capable of guiding the connection target, and also capable of suppressing an increase in the size of the housing.

In a connector according to a second aspect of the present disclosure, the shield member is provided with an auxiliary shield portion that is disposed at least partially overlapping the coupling portion and the guide face of the housing as viewed in the insertion-removal direction, and that suppresses propagation of electromagnetic waves.

In the connector according to the second aspect, the auxiliary shield portion is added to the pair of shield portions, thereby enabling the range in which the propagation of electromagnetic waves is suppressed in the connector to be enlarged. Furthermore, the auxiliary shield portion is disposed so as to at least partially overlap the coupling portion and the guide face of the housing as viewed in the insertion-removal direction. This suppresses an increase in the length of the housing compared to configurations in which the auxiliary shield portion is disposed so as not to overlap the coupling portion and the guide face. This thereby prevents the size of the connector from increasing.

In a connector according to a third aspect of the present disclosure, the housing is provided with a restriction section that restricts displacement of the auxiliary shield portion in a second direction intersecting the insertion-removal direction.

In the connector according to the third aspect, when the auxiliary shield portion is displaced by an external force acting on the shield member, the restriction section restricts the displacement of the auxiliary shield portion, enabling the auxiliary shield portion to be suppressed from coming apart from the housing more effectively than in configurations in which the restriction portion is not provided.

In a connector according to a fourth aspect of the present disclosure, the restriction section includes a contact face that is capable of contacting the auxiliary shield portion.

In the connector according to the fourth aspect, it is sufficient simply to form the contact face at the housing, thereby enabling an increase in the number of members to be suppressed compared to configurations in which a restriction section is provided at the housing as a separate member that is distinct from the housing.

In a connector according to a fifth aspect of the present disclosure, the restriction section includes a side wall that covers the auxiliary shield portion as viewed in the second direction intersecting the insertion-removal direction, the second direction intersecting the insertion-removal direction being orthogonal to both the insertion-removal direction and the first direction intersecting the insertion-removal direction.

In the connector according to the fifth aspect, displacement of the auxiliary shield portion in the second direction intersecting the insertion-removal direction can be restricted. Furthermore, the auxiliary shield portion is not exposed to the outside of the housing. This restricts contact between the auxiliary shield portion and other members or the hands of an operator, thereby enabling deformation of the auxiliary shield portion to be suppressed.

In a connector according to a sixth aspect of the present disclosure, the connection target includes a body with a terminal face that is exposed in the first direction intersecting the insertion-removal direction, and a projection portion that is formed further toward the insertion-removal side in the insertion-removal direction of the body than the terminal face, and the projection portion projects in the first direction intersecting the insertion-removal direction. The shield member is provided with a pressing portion that is disposed further toward an inner side than the auxiliary shield portion and the pressing portion is capable of elastic deformation, the pressing portion is configured so as to contact the projection portion of the connection target and thereafter to contact the terminal face of the connection target to apply a pressing force to the connection target in a case in which the connection target is inserted through the insertion-removal port of the housing.

In the connector according to the sixth aspect, when connecting the connection target to the housing, the pressing portion and the terminal face contact each other after the projection portion is contacted the pressing portion and passed beyond the pressing portion. Note that when external force in a removal direction acts on the connection target, the pressing portion and the projection portion contact each other, such that movement of the connection target is temporarily restricted. This enables unintended removal of the connection target connected to the connector to be suppressed.

In a connector according to a seventh aspect of the present disclosure, an attachment site is formed at the housing, and an attachment portion that extends in the insertion-removal direction for attachment to the attachment site is provided between the pressing portion and the auxiliary shield portion of the shield member.

In the connector according to the seventh aspect, the rigidity of the shield members with respect to force from the pressing portion toward the auxiliary shield portion is increased by the attachment portion provided between the pressing portion and the auxiliary shield portion. This enables displacement of the auxiliary shield portion due to displacement of the pressing portion when the connection target is connected to the socket connector to be more effectively suppressed than in configurations in which the attachment portion is not provided between the pressing portion and the auxiliary shield portion.

The connector according to the respective aspects of the present disclosure is capable of guiding the connection target, and also capable of suppressing an increase in the size of the housing in a configuration in which the housing is provided with the shield members.

BRIEF DESCRIPTION OF THE DRAWINGS

Exemplary embodiments of the present disclosure will be described in detail based on the following figures, wherein.

DETAILED DESCRIPTION

Explanation follows regarding a socket connector 10 and a plug connector 12 according to an exemplary embodiment.

Overall Configuration

Figure 1:
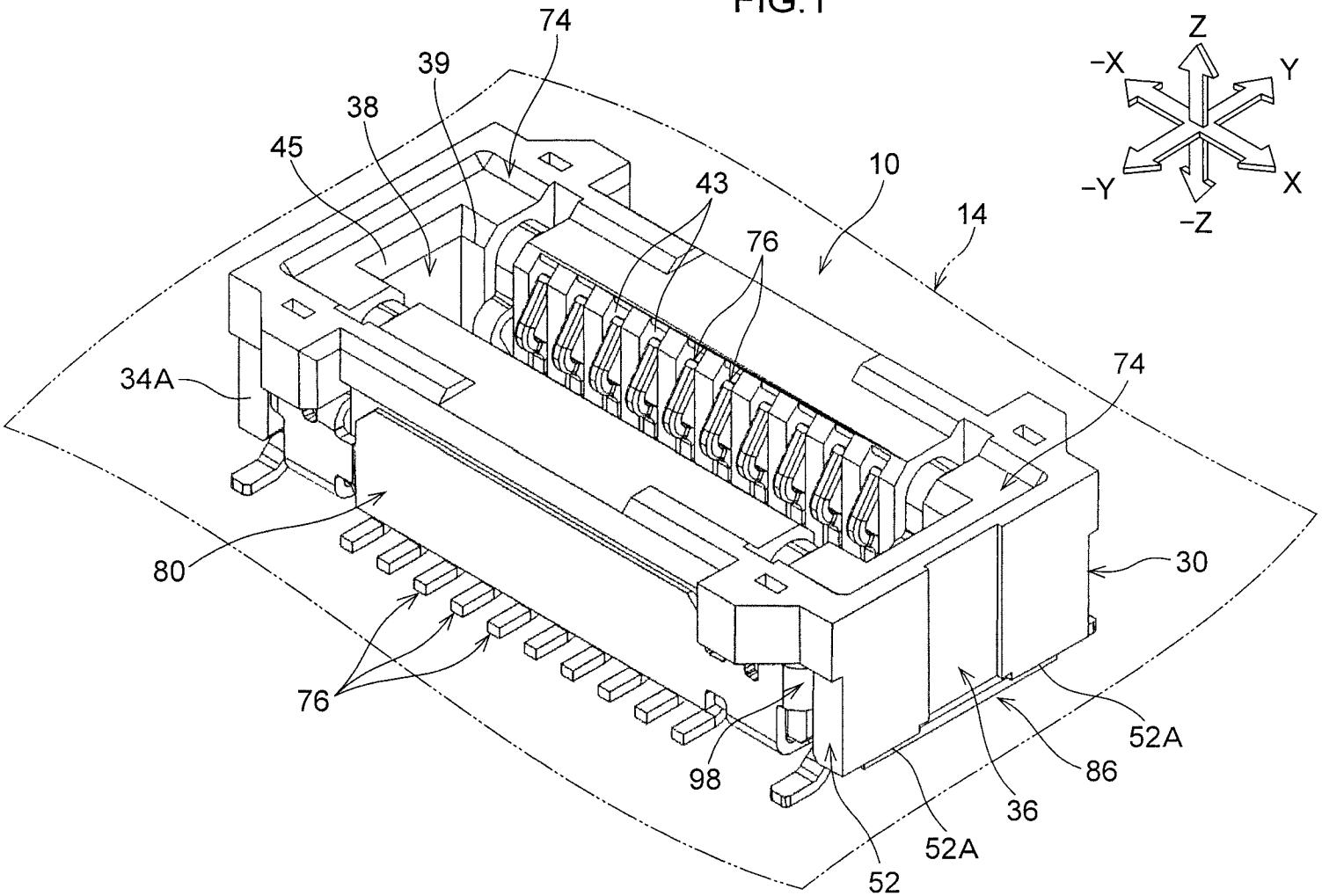
FIG. 1 is a perspective view of a socket connector according to an exemplary embodiment.

The socket connector 10 illustrated in FIG. 1 is an example of a connector. The plug connector 12 (see FIG. 2), described later, can be inserted into and removed from the socket connector 10. In the below explanation, an insertion-removal direction in which the plug connector 12 is inserted into and removed from the socket connector 10 is referred to as the Z direction. In a plane (not illustrated in the drawings) orthogonal to the Z direction, a length direction of the socket connector 10 is referred to as the X direction, and a breadth direction of the socket connector 10 is referred to as the Y direction. The X direction, the Y direction, and the Z direction are mutually orthogonal to one another. The X direction corresponds to a second direction intersecting the insertion-removal direction of the connector. The Y direction corresponds to a first direction intersecting the insertion-removal direction of the connector.

When distinguishing between one side and the other side of the socket connector 10 with respect to a central position in the Z direction of the socket connector 10, a side closer to the plug connector 12 (see FIG. 2) is referred to as the Z side, and a side further from the plug connector 12 is referred to as the −Z side. When distinguishing between one side and the other side of the socket connector 10 with respect to a central position in the X direction of the socket connector 10, when viewing a reference face 34A face, described later, face-on, the right side is referred to as the X side, and the left side is referred to as the −X side. When distinguishing between one side and the other side of the socket connector 10 with respect to a central position in the Y direction of the socket connector 10, when viewing the reference face 34A face-on, the far side is referred to as the Y side, and the near side is referred to as the −Y side. Note that reference numerals are sometimes omitted from the drawings in order to facilitate viewing of the drawings.

The socket connector 10 is mounted to a first substrate 14, serving as a substrate. A through-hole, not illustrated in the drawings, is formed passing through the first substrate 14 in the Z direction. The plug connector 12 is mounted to a second substrate 16 (see FIG. 2). An electrical connection is formed between a non-illustrated circuit of the first substrate 14 and a non-illustrated circuit of the second substrate 16 when the socket connector 10 and the plug connector 12 are connected to each other (fitted together).

Plug Connector

Figure 2:
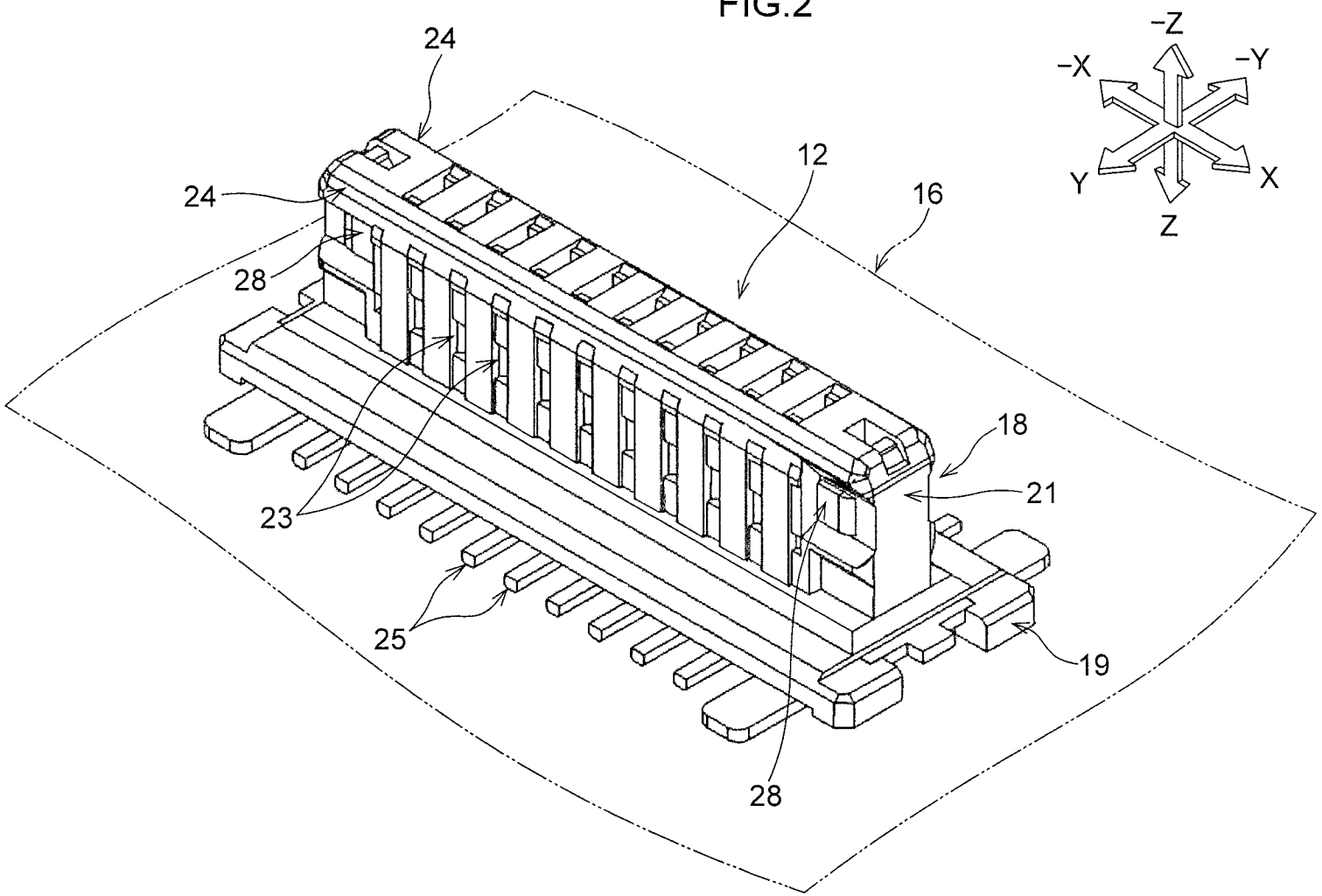
FIG. 2 is a perspective view of a plug connector according to the present exemplary embodiment.

The plug connector 12 illustrated in FIG. 2 is an example of a connection target. The plug connector 12 includes a plug housing 18 serving as a body, projection portions 24 formed at the plug housing 18, plural terminal portions 25 including a power source terminal, and earth terminals 28. The plug housing 18 is made from an insulating resin, and includes a bottom plate 19 disposed running along the second substrate 16, and an upstanding section 21 upstanding from the bottom plate 19 in the Z direction.

The upstanding section 21 is formed in a substantially rectangular block shape with its breadth direction along the Y direction and its length direction along the X direction. The upstanding section 21 is formed with plural indented portions 23, to which the plural terminal portions 25 are attached, arrayed along the X direction. The plural terminal portions 25 include the power source terminal. The earth terminals 28 are provided on an X side and a −X side of the upstanding section 21 with respect to the plural indented portions 23.

Figure 13:
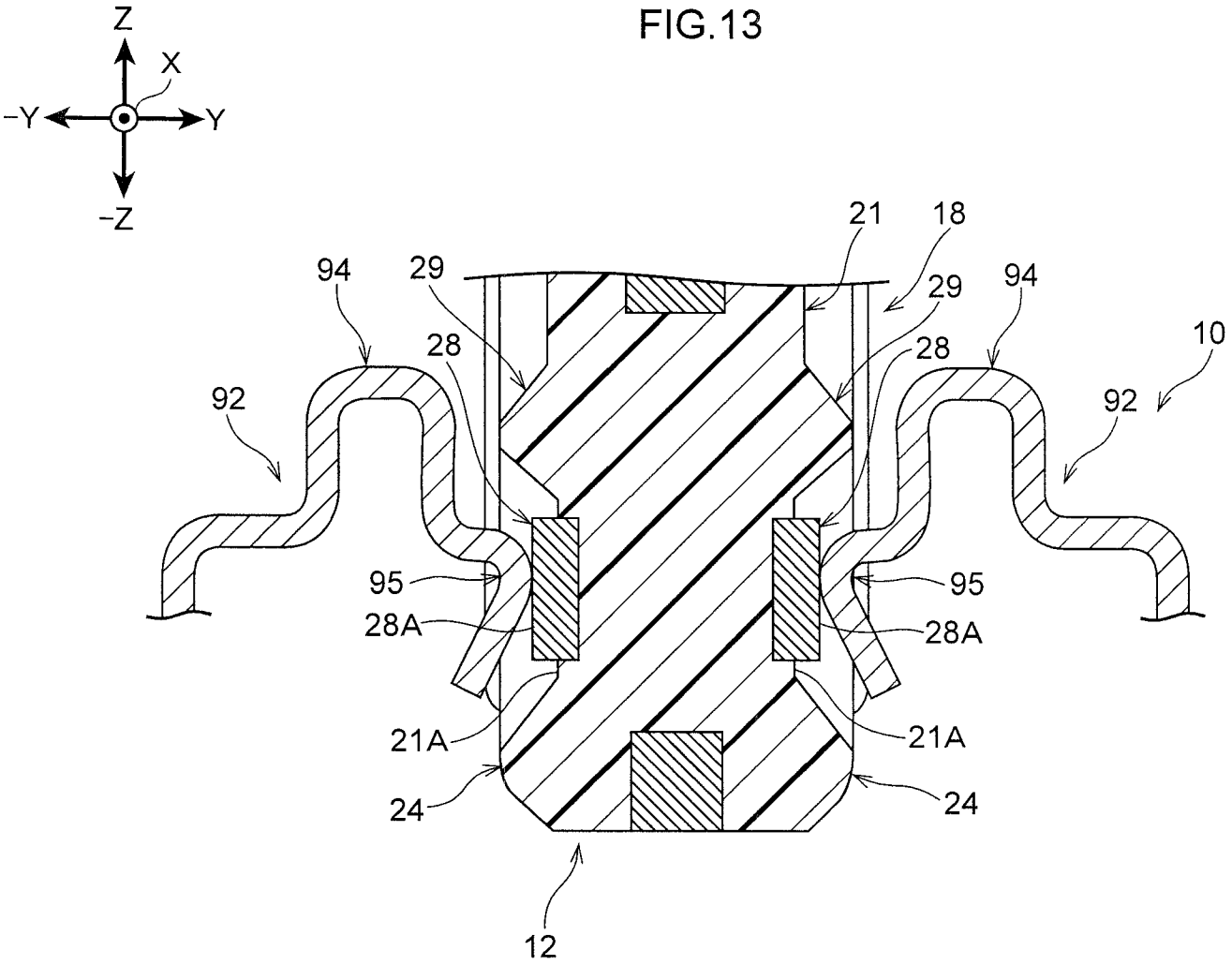
FIG. 13 is a vertical cross-section illustrating a state in which pressing portions according to the present exemplary embodiment contact terminal faces of the plug connector.

As illustrated in FIG. 13, the projection portions 24 are formed at the upstanding section 21. Specifically, in a connected state of the socket connector 10 and the plug connector 12, as viewed in the X direction, the projection portions 24 are located at side faces 21A that are disposed on a Y side and a −Y side at a −Z side end portion of the upstanding section 21. The projection portions 24 project in substantially trapezoidal shapes toward the Y direction outer sides from the side faces 21A. The earth terminals 28 are disposed on the Z side of the upstanding section 21 with respect to the projection portions 24. Auxiliary projection portions 29 are formed on the Z side of the upstanding section 21 with respect to the earth terminals 28, so as to project from the side faces 21A toward the Y direction outer sides.

Each of the earth terminals 28 is formed in a plate shape including a terminal face 28A. The terminal faces 28A are planar faces lying in an X-Z plane, and are exposed from the upstanding section 21 in the Y direction. The earth terminals 28 are disposed between the projection portions 24 and the auxiliary projection portions 29 in the Z direction. In other words, the projection portions 24 are formed further toward a Z direction leading end side (an insertion-removal section 38 (see FIG. 1) side, described later) of the plug housing 18 than the terminal faces 28A, and project out further in the Y direction than the terminal faces 28A.

Configuration of Relevant Portions

Detailed explanation follows regarding the socket connector 10.

The socket connector 10 illustrated in FIG. 1 includes a single housing 30 fixed to the first substrate 14, plural terminal members 76 attached to the housing 30, and a single shield member 80. Note that the socket connector 10 has a similar configuration (is symmetrical) on the Y side and the −Y side about its Y direction central position. The socket connector 10 also has a similar configuration (is symmetrical) on the X side and the −X side about its X direction central position. The following explanation therefore focuses on configuration of the −Y side and X side of the socket connector 10, and explanation regarding configuration on the Y side and −X side is sometimes omitted.

Housing

Figure 3:
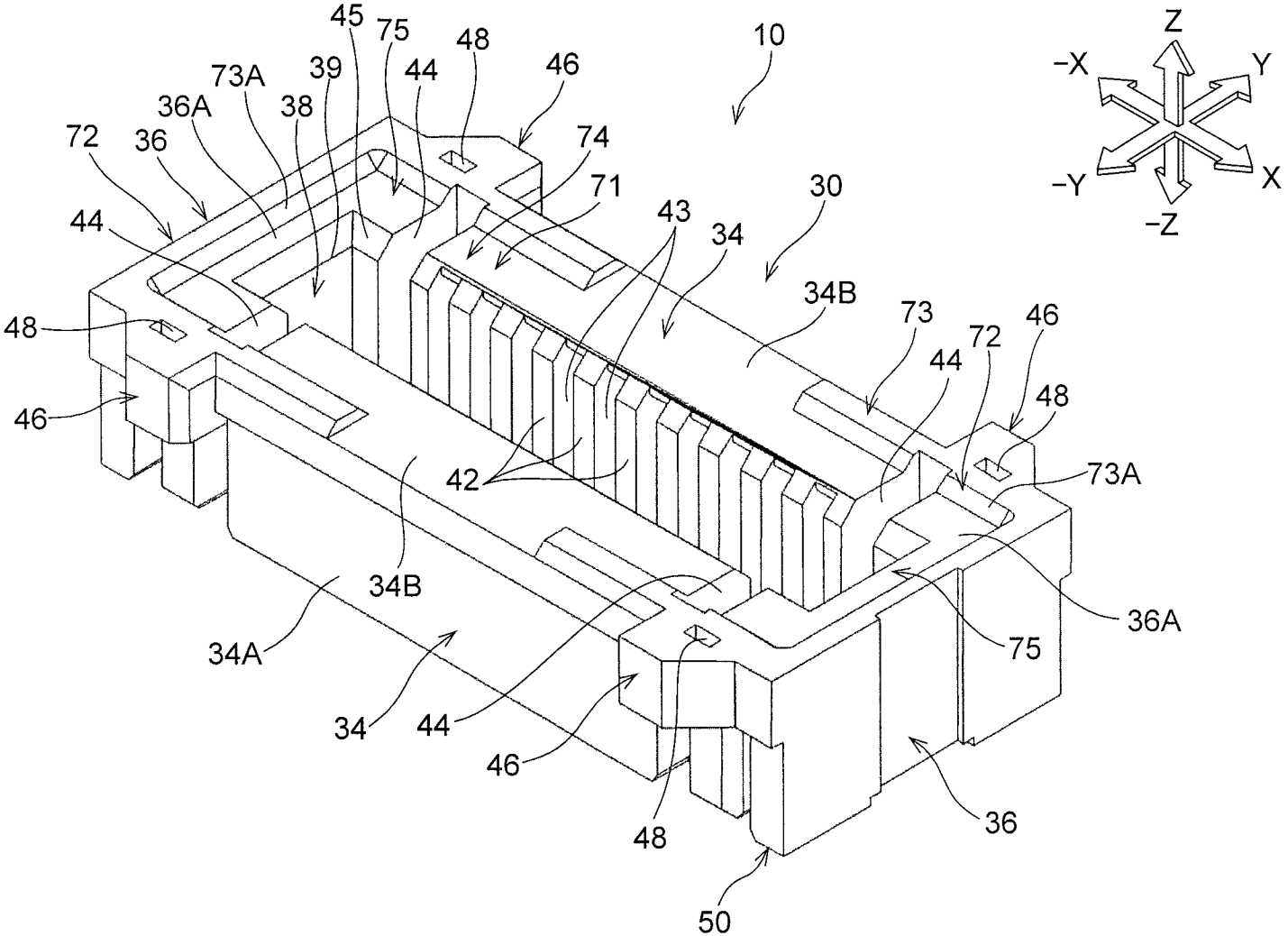
FIG. 3 is a perspective view of housing according to the present exemplary embodiment.

The housing 30 illustrated in FIG. 3 is made from an insulating resin. The housing 30 includes a bottom wall 32 (see FIG. 5) extending along an X-Y plane, a set of side walls 34 upstanding from the bottom wall 32 toward the Z direction Z side and opposing each other in the Y direction, and a set of side walls 36 upstanding from the bottom wall 32 toward the Z direction Z side and opposing each other in the X direction. Namely, the housing 30 is formed with a rectangular block shape open toward the Z side. As viewed in the Z direction, the housing 30 has a substantially rectangular shaped outer profile with its length direction along the X direction and its breadth direction along the Y direction. The housing 30 is provided with restriction sections 50, each serving as an example of a restriction section that restricts displacement of auxiliary shield portions 98 (see FIG. 11), described later.

Figure 5:
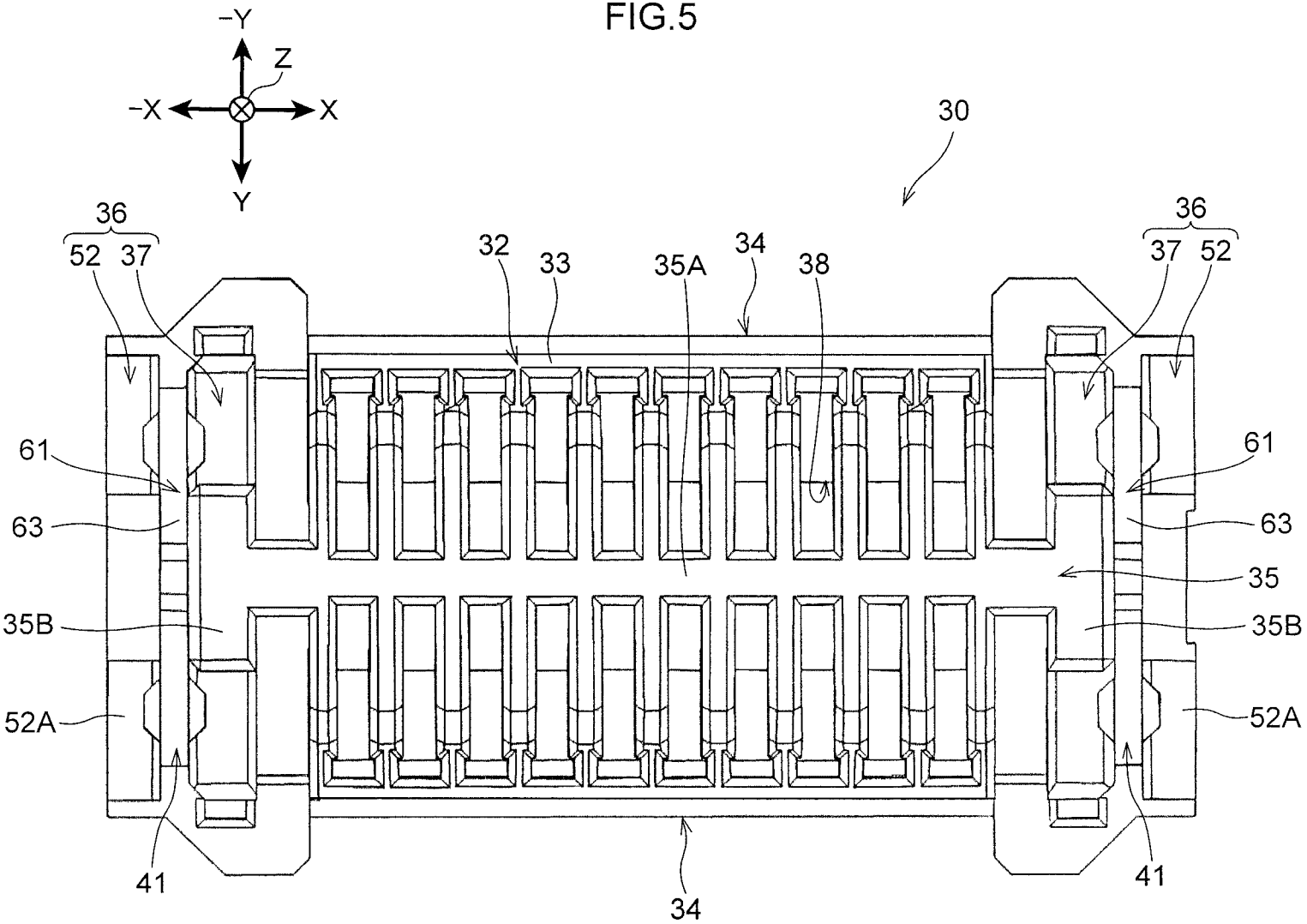
FIG. 5 is a bottom view of the housing according to the present exemplary embodiment.

A face at the −Z side of the bottom wall 32 illustrated in FIG. 5 is referred to as a lower face 33. The lower face 33 is disposed lying in an X-Y plane. A raised portion 35 that is raised from the lower face 33 toward the −Z side except at an outer edge portion is formed at the lower face 33. As an example, the raised portion 35 includes an extension portion 35A extending along the X direction, and jutting-out portions 35B that jut out toward the Y side and −Y side at both end portions in the X direction of the extension portion 35A.

A location configured by inner side faces of the set of side walls 34 and inner side faces of a set of side walls 36 illustrated in FIG. 3 is referred to as the insertion-removal section 38. The insertion-removal section 38 has a hollow interior extending along the X direction and the Y direction. An opening at a Z side end portion of the insertion-removal section 38 is referred to as an insertion-removal port 39. The plug connector 12 (see FIG. 2) is inserted into and removed from (placed into and taken out of) the insertion-removal section 38 in the Z direction through the insertion-removal port 39.

The side walls 34 extend along the X direction with their thickness direction in the Y direction. As viewed in the Y direction, each of the side walls 34 is formed in a rectangular shape with its length direction along the X direction and its breadth direction along the Z direction. Note that a side face of the side wall 34 on the −Y side is referred to as the reference face 34A. A Z side face of each of the side walls 34 is referred to as an upper face 34B. Plural small chambers 43 that are divided from each other in the X direction by plural partitioning walls 42 are formed at the insertion-removal section 38 at the side walls 34. The terminal members 76 (see FIG. 1), described later, are attached to parts of walls configuring the small chambers 43. The terminal members 76 are thus partially exposed toward the insertion-removal section 38.

Figure 4:
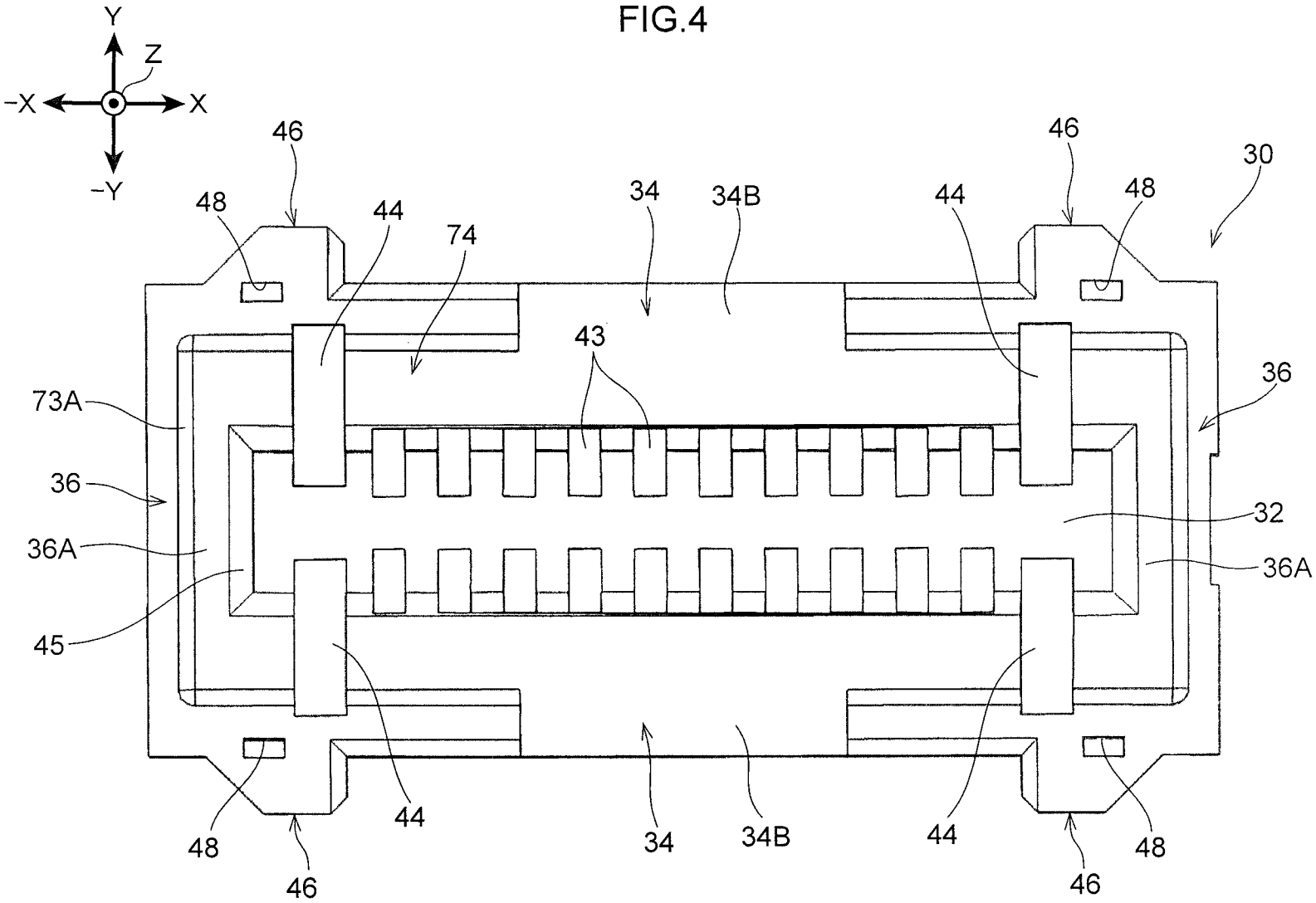
FIG. 4 is a plan view of a housing according to the present exemplary embodiment.

As illustrated in FIG. 4, passages 44 that pass through the side walls 34 in the Z direction are formed on the X side and the −X side of the plural small chambers 43 at each of the side walls 34. As viewed in the Z direction, each of the passages 44 is formed in a rectangular shape with its length along the Y direction. End portions of the passages 44 pass through the bottom wall 32 in the Z direction.

Jutting-out portions 46 are formed at Z side end portions of the side walls 34 and at Y direction outer sides of the passages 44 so as to jut out from the side walls 34 toward the outer sides (the Y side and the −Y side). The jutting-out portions 46 are examples of attachment sites. As viewed in the Z direction, each of the jutting-out portions 46 is formed in a trapezoidal block shape with its thickness direction along the Z direction. An attachment hole 48 that passes through the corresponding side wall 34 and jutting-out portion 46 in the Z direction is formed in a base end portion of each of the jutting-out portions 46. As viewed in the Z direction, each of the attachment holes 48 is formed in a rectangular shape with its length along the X direction.

As illustrated in FIG. 3, the side walls 36 are disposed further toward X direction outer sides (the X side and the −X side) than the passages 44. The side walls 36 extend along the Y direction with their thickness direction along the X direction. As viewed in the X direction, each of the side walls 36 is formed in a rectangular shape with its length direction along the Y direction and its breadth direction along the Z direction. A Z side face of each of the side walls 36 is referred to as an upper face 36A.

As illustrated in FIG. 5, each of the side walls 36 includes an upright wall 37 and an upright wall 52 that oppose each other in the X direction. Note that the upright wall 52 is described in detail later. The upright wall 37 is disposed on a side that is closer to the insertion-removal section 38 than the upright wall 52. A Z side end portion of the upright wall 37 and a Z side end portion of the upright wall 52 are linked together by an upper wall portion 41. An indented portion 62 (see FIG. 11) that is indented toward an insertion-removal section 38 side is formed at the upright wall 37. Note that the indented portion 62 and a space 63 provided between the upright wall 37 and the upright wall 52 are collectively referred to as an accommodating section 61. The accommodating section 61 is open toward the Y side, the −Y side, and the −Z side.

Figure 11:
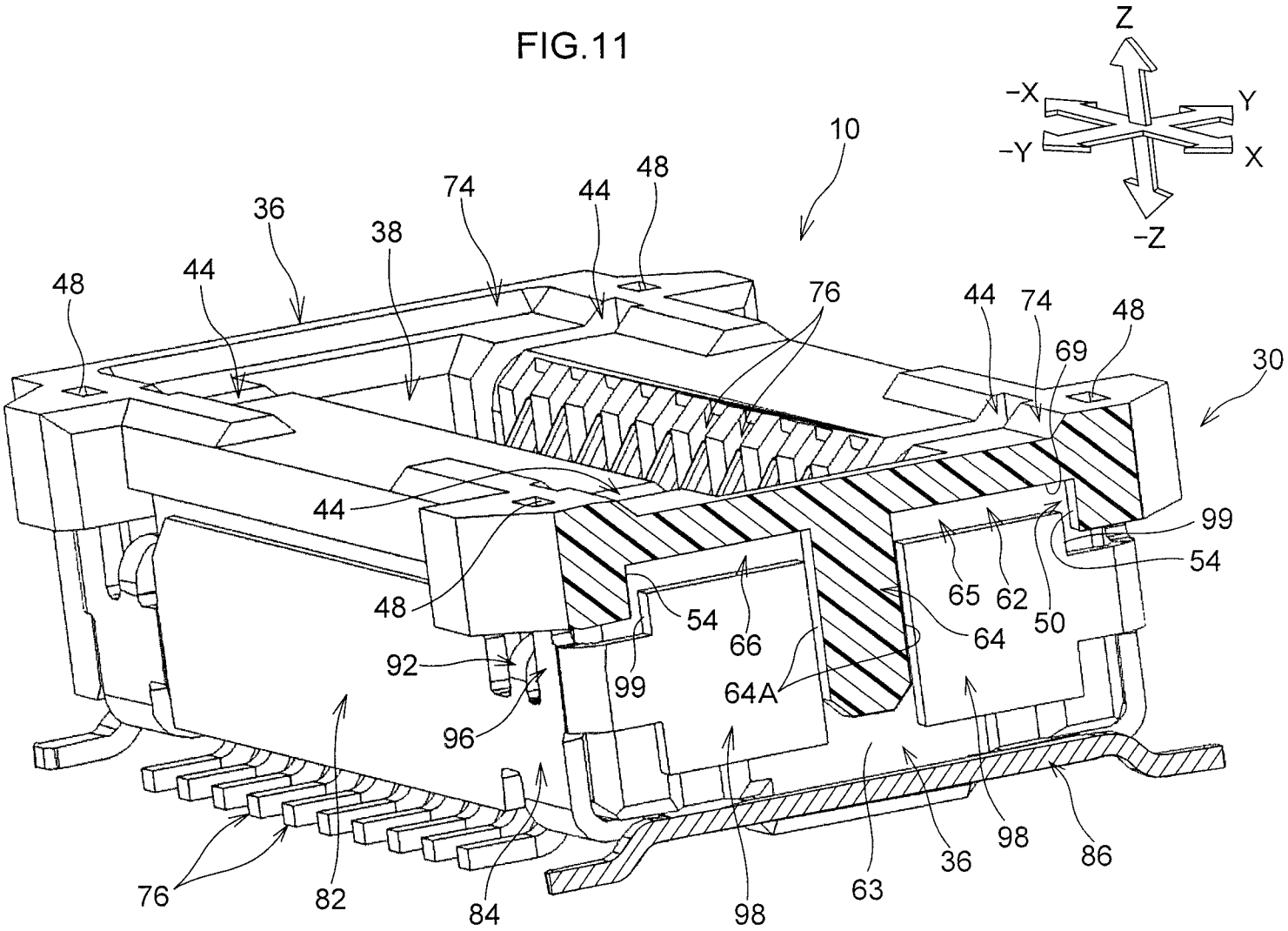
FIG. 11 is an explanatory diagram illustrating placement of the auxiliary shield portion and opposing faces according to the present exemplary embodiment.

As illustrated in FIG. 11, a dividing wall 64, which extends from a Z side end portion toward the −Z side at a Y direction central portion of the corresponding side wall 36, is formed at the indented portion 62. The indented portion 62 is divided into a first indented portion 65 on the Y side and a second indented portion 66 on the −Y side by the dividing wall 64. The dividing wall 64 includes a pair of side faces 64A, each lying in an X-Z plane. The first indented portion 65 and the second indented portion 66 are configured symmetrically to each other with respect to the dividing wall 64, and other than their placement, have the same configuration as each other. Explanation therefore follows regarding the first indented portion 65, and explanation regarding the second indented portion 66 is omitted.

As viewed in the X direction, the first indented portion 65 is formed with an opposing face 54 that opposes the corresponding side face 64A in the Y direction across a gap, and a lower face 69 at an upper portion of the first indented portion 65 links a Z side end of the opposing face 54 and a Z side end of the corresponding side face 64A together.

Restriction Sections

Each of the restriction sections 50 includes the upright wall 52 (see FIG. 5) and the opposing faces 54. Note that "the restriction section 50 is provided at the housing 30" includes cases in which the restriction section 50 is formed at the housing 30, and also cases in which another member serving as the restriction section 50 is provided at the housing 30.

Each of the upright walls 52 illustrated in FIG. 5 is an example of a side wall portion, and is formed at the housing 30. The upright walls 52 are disposed at both X direction side ends of the housing 30. Each of the upright walls 52 extends along a Y-Z plane. A location of each of the upright walls 52 at an opposite side in the Z direction (−Z side) from the insertion-removal port 39 (see FIG. 3) of the housing 30 is referred to as a lower end portion 52A. As illustrated in FIG. 1, the upright walls 52 cover the auxiliary shield portions 98, described later, when viewed in the X direction.

Each of the opposing faces 54 illustrated in FIG. 11 is an example of a contact face. Each opposing face 54 is disposed opposing a Z side end portion of the corresponding side face 64A in the Y direction, and is formed at the housing 30 so as to be capable of contacting the corresponding auxiliary shield portion 98, described later. In other words, the opposing face 54 is formed so as to restrict displacement of the auxiliary shield portion 98 in the Y direction. As viewed in the Y direction, each opposing face 54 is formed in a rectangular shape with its breadth direction along the X direction and its length direction along the Z direction. A Z direction length of the opposing face 54 is approximately one third of a Z direction length of the dividing wall 64.

Guide Sections

As illustrated in FIG. 3, guide sections 72 are formed on an insertion-removal port 39 side (the Z side) of the housing 30 at a peripheral portion 71 of the insertion-removal section 38. Note that the peripheral portion 71 not only includes a peripheral edge of the insertion-removal port 39, but also the upper faces 34B and the upper faces 36A.

Each of the guide sections 72 is a location formed straddling the upper faces 34B and one of the upper faces 36A. The guide sections 72 are disposed symmetrically to each other on the X side and the −X side about the X direction central position of the housing 30. Each of the guide sections 72 is formed by a raised portion 73 that is raised from the upper faces 34B and the corresponding upper face 36A toward the Z side, and a bottom face portion 75 that includes the upper faces 34B and the corresponding upper face 36A at locations further toward an inner side than the raised portion 73. As viewed from the Z side, each of the guide sections 72 is formed in a substantially U shape.

The housing 30 includes guide faces 74. Each of the guide faces 74 is configured by an inclined face 73A formed at the raised portion 73, the upper faces 34B and the corresponding upper face 36A, and an inclined face 45 formed at an inner wall face configuring the insertion-removal port 39. Each of the inclined faces 73A extends in a direction inclined with respect to the Z direction from a Z side end face of the raised portion 73 toward the upper faces 34B and the corresponding upper face 36A. Each of the inclined faces 45 extends in a direction inclined with respect to the Z direction from inner side ends of the upper faces 34B and the corresponding upper face 36A toward the inner side (the insertion-removal section 38 side), such that the inner side is lower than the outer side. The guide faces 74 are faces that contact the plug connector 12 (see FIG. 2) so as to guide the plug connector 12 toward the insertion-removal section 38 when the plug connector 12 is being connected to the socket connector 10.

As illustrated in FIG. 4, as viewed in the Z direction, each of the guide faces 74 is formed in a substantially U shape overall by two locations extending in a linear shape along the X direction and a location extending in a linear shape along the Y direction.

Terminal Members

The plural terminal members 76 illustrated in FIG. 1 undergo elastic deformation during connection to the plural terminal portions 25 (see FIG. 2). Each of the plural terminal members 76 is provided (attached) at inside of each of the plural small chambers 43.

Shield Member

Figure 6:
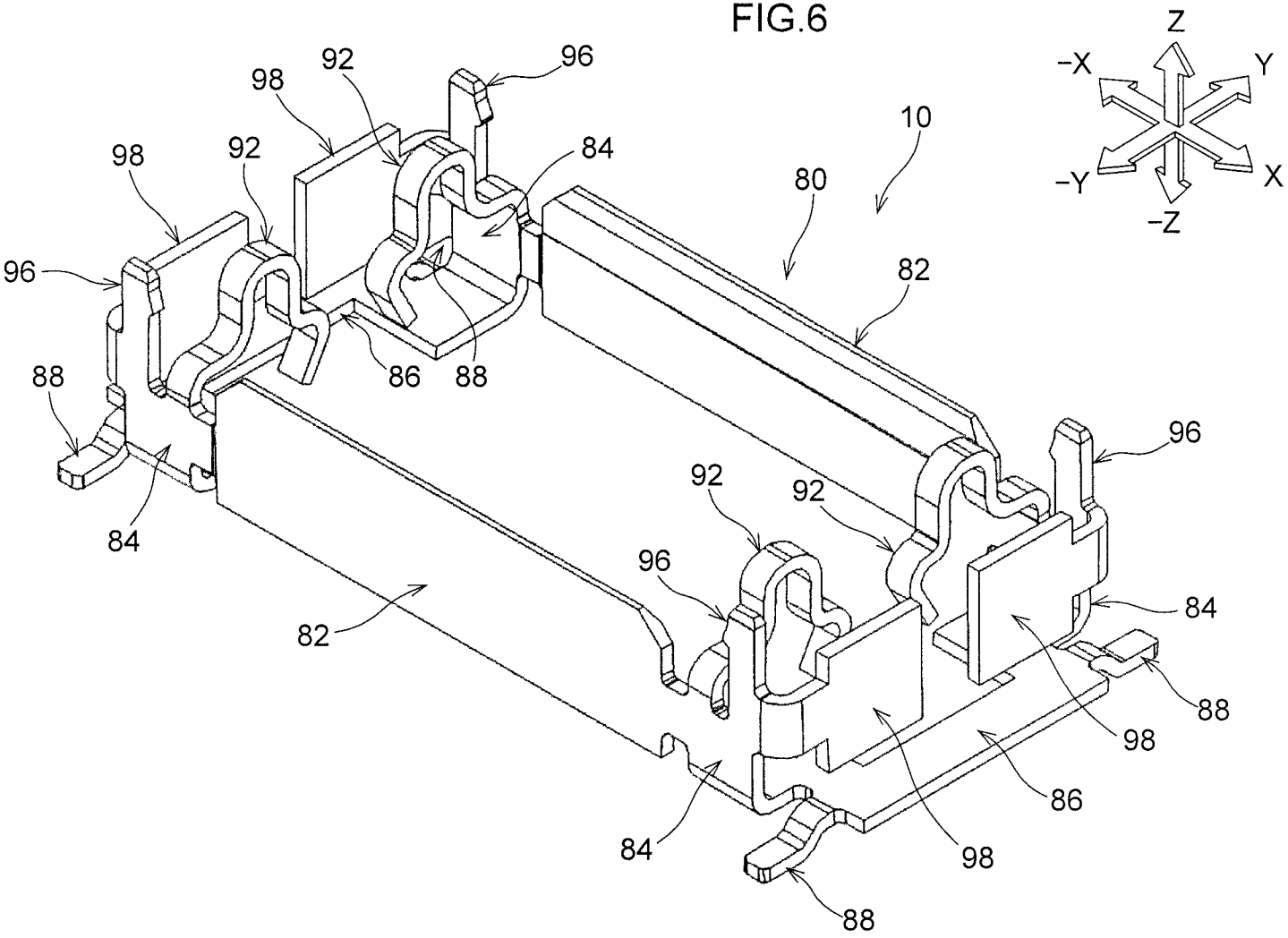
FIG. 6 is a perspective view of a shield member according to the present exemplary embodiment.

The shield member 80 illustrated in FIG. 6 includes a pair of shield portions 82, four intermediate portions 84, a pair of coupling portions 86, four leg portions 88, four pressing portions 92, four attachment portions 96, and four of the auxiliary shield portions 98. As an example, the shield member 80 is made of phosphor bronze. Note that as long as the shield member 80 has a function of suppressing propagation of electromagnetic waves, there is no limitation to phosphor bronze, and the shield member 80 may be configured of another material.

Figure 7:
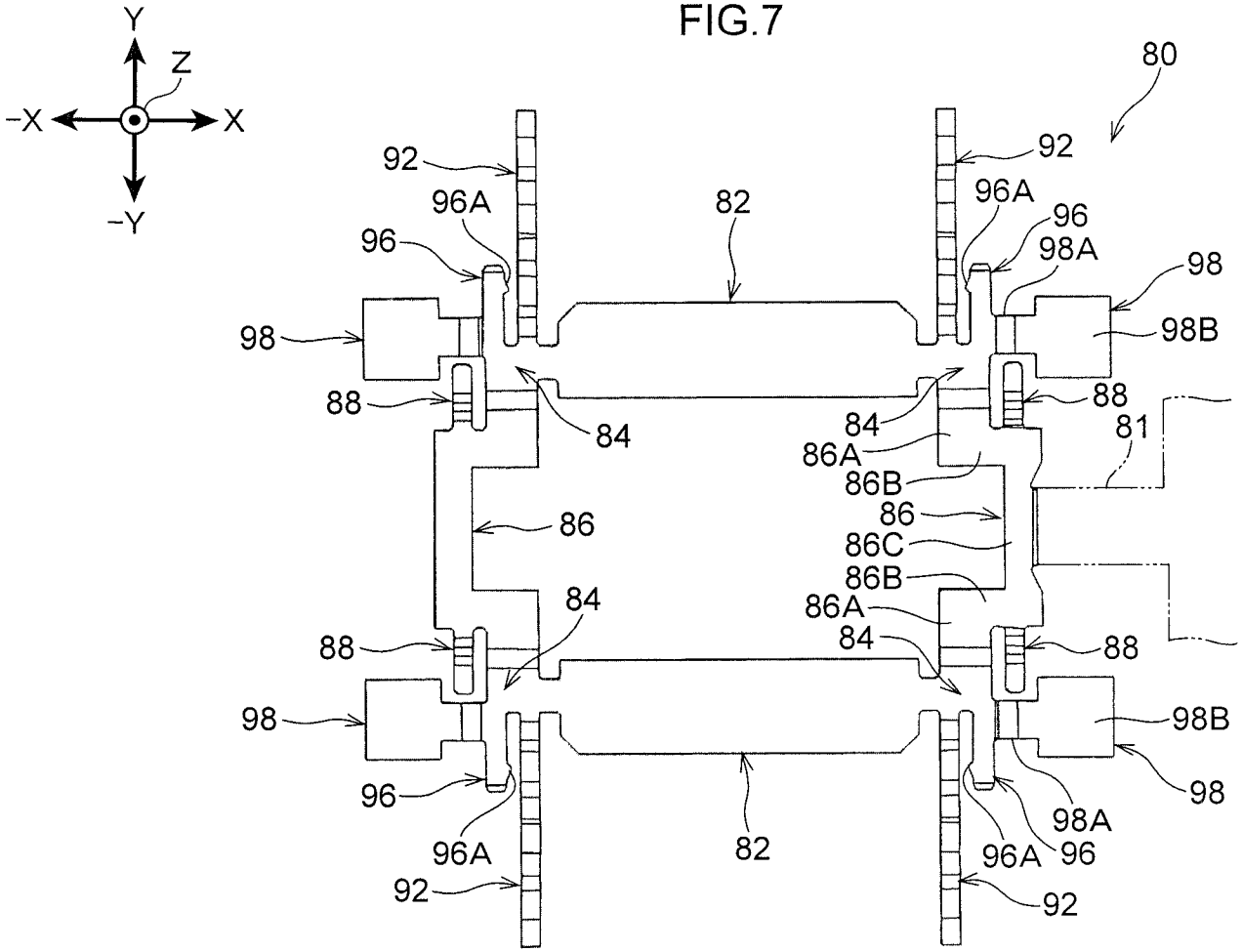
FIG. 7 is an opened-out view of a shield member according to the present exemplary embodiment.

FIG. 7 illustrates an opened-out state of the shield member 80 prior to performing fold-bending thereon. The shield member 80 in the opened-out state is formed by punching a metal sheet using a pressing apparatus, not illustrated in the drawings. In other words, the shield portions 82, the intermediate portions 84, the coupling portions 86, the leg portions 88, the pressing portions 92, the attachment portions 96, and the auxiliary shield portions 98 are formed as an integral unit. A carrier portion 81 used for conveyance is linked to one of the pair of coupling portions 86 shortly after pressing. However, this carrier portion 81 is cut off using a cutter, not illustrated in the drawings, thereby separating the shield member 80 from the carrier portion 81. After being separated from the carrier portion 81, fold-bending is performed on preset fold-bend locations using processing equipment, not illustrated in the drawings, to complete the shield member 80.

Shield Portions

The pair of shield portions 82 illustrated in FIG. 6 are disposed on both sides in the Y direction of the housing 30 (see FIG. 3), and have a function of suppressing the propagation of electromagnetic waves (internal and external noise of the socket connector 10). Specifically, as viewed in the Y direction, each of the shield portions 82 is formed in a substantially rectangular shape with its length direction along the X direction and its breadth direction along the Z direction. As viewed in the Y direction, the size of each of the shield portions 82 is a size covering a range corresponding to approximately two thirds of the reference face 34A (see FIG. 3).

Intermediate Portions

As viewed in the Y direction, the four intermediate portions 84 are each formed with a square shape. One set of two of the four intermediate portions 84 is disposed on the Y side, and one set of two of the four intermediate portions 84 is disposed on the −Y side. Specifically, the intermediate portions 84 are disposed singly on the X side and the −X side of each of the shield portions 82, and are linked to the corresponding shield portion 82 in the X direction. As viewed in the Y direction, the intermediate portions 84 cover part of the reference face 34A (see FIG. 3).

Coupling Portions

As viewed in the Z direction, each of the coupling portions 86 illustrated in FIG. 7 is formed in a substantially U shape open toward an X direction inner side. Specifically, each of the coupling portions 86 includes two plates 86A linked to the corresponding intermediate portions 84 in the Y direction, two plates 86B extending from the two plates 86A toward an X direction outer side, and one plate 86C linking the two plates 86B together in the Y direction. Namely, the coupling portions 86 are coupled to the pair of shield portions 82 in the Y direction through the intermediate portions 84. An X direction length of each of the plates 86B is longer than an X direction length of each of the jutting-out portions 35B (see FIG. 5). A Y direction length of each of the plates 86C is longer than a Y direction length of each of the jutting-out portions 35B.

The size of each of the coupling portions 86 is set to a size whereby the coupling portions 86 contact the lower end portions 52A (see FIG. 5) in a state in which the shield member 80 has been assembled to the housing 30 (see FIG. 3). The coupling portions 86 are disposed so as to at least partially overlap the guide faces 74 (see FIG. 3) as viewed in the Z direction in a state in which the shield member 80 has been assembled to the housing 30. Note that the placement of the coupling portions 86 is described in detail later.

Leg Portions

Figure 8:
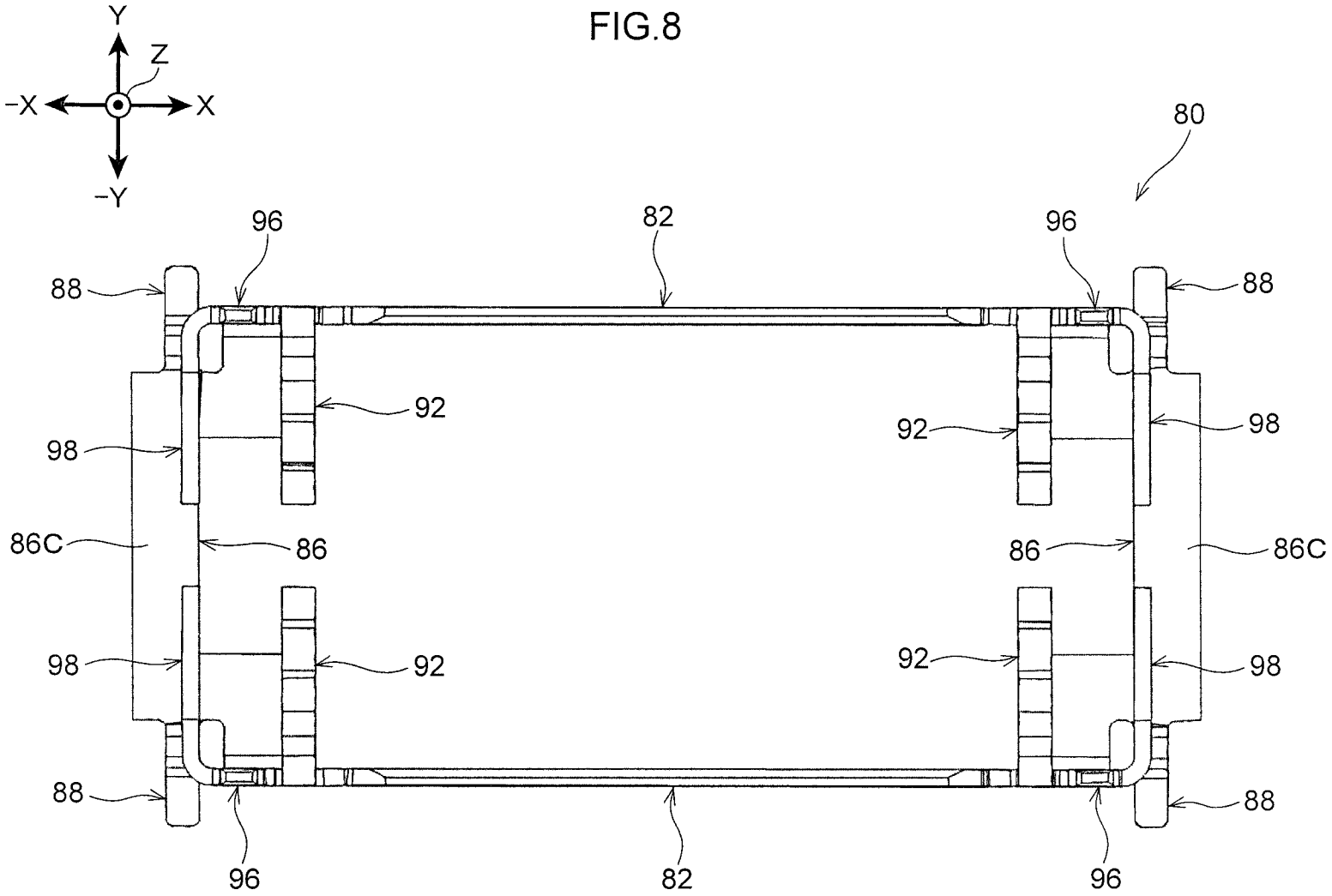
FIG. 8 is a plan view of a shield member according to the present exemplary embodiment.
Figure 9:
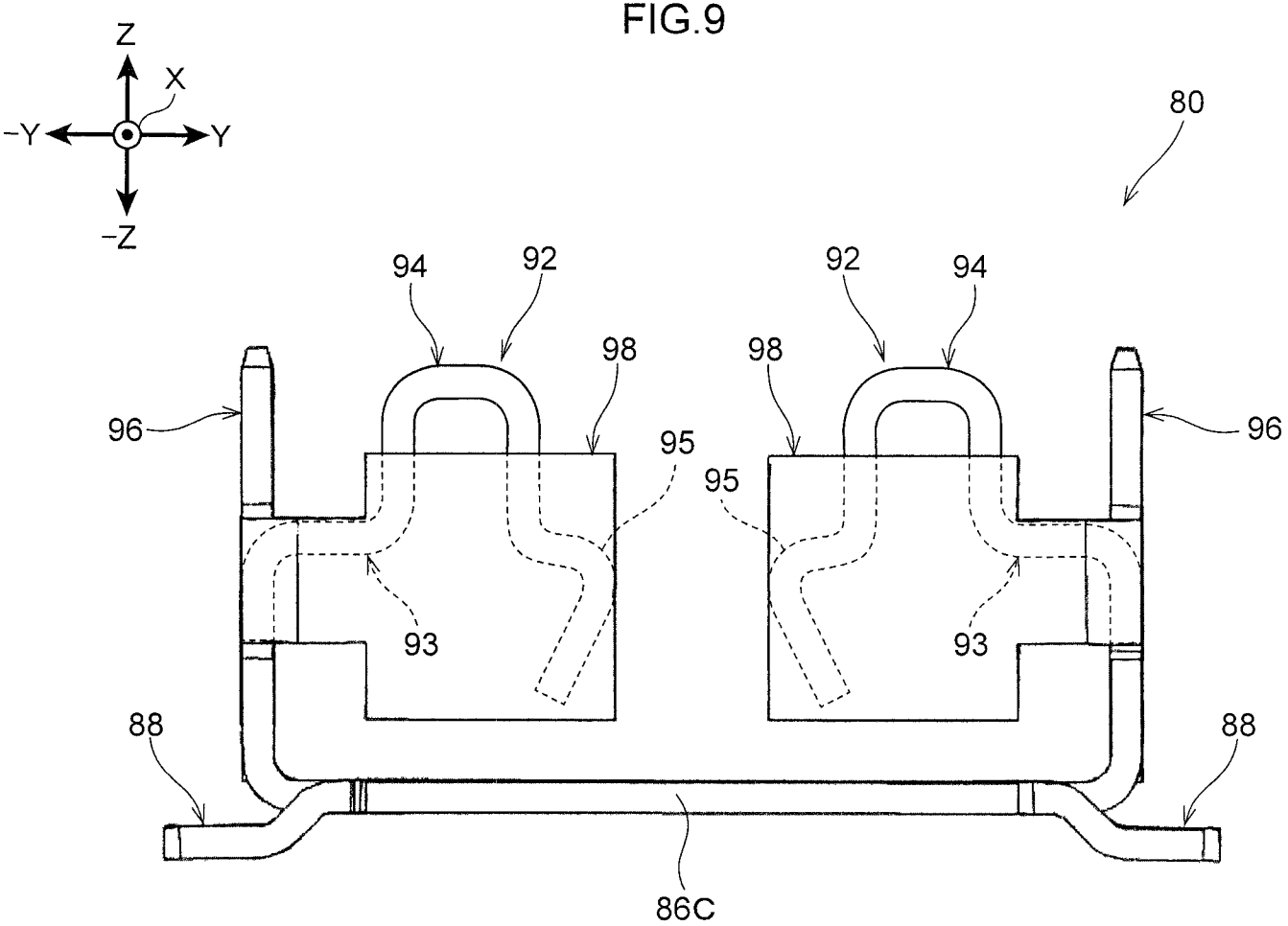
FIG. 9 is a side view of at a side of an auxiliary shield portion of the shield member according to the present exemplary embodiment.

As viewed in the Z direction the leg portions 88 illustrated in FIG. 8 extend in the Y direction from both Y direction end portions of the plates 86C toward the Y side or the −Y side. As illustrated in FIG. 9, as viewed in the X direction, each of the leg portions 88 is bent into a crank shape so as to be positioned further toward the −Z side than the corresponding plate 86C. The leg portions 88 are soldered to non-illustrated earth lines of the first substrate 14 (see FIG. 1).

Pressing Portions

As illustrated in FIG. 6, the pressing portions 92 are disposed further toward an X direction inner side (center side) than the auxiliary shield portions 98, described later, and are capable of elastic deformation in at least the Y direction. Two of the four pressing portions 92 are disposed on the X side of the shield member 80, and two of the four pressing portions 92 are disposed on the −X side of the shield member 80. The X side and −X side pressing portions 92 are disposed with line symmetry to each other about a non-illustrated axis of symmetry extending along the Z direction at the X direction central position of the shield member 80. Explanation therefore follows regarding the two pressing portions 92 on the X side, and explanation regarding the two pressing portions 92 on the −X side is omitted. These two pressing portions 92 are disposed with line symmetry about a non-illustrated axis of symmetry extending along the Z direction at the Y direction central position of the shield member 80. Namely, two contact portions 95 are disposed facing each other across a gap in the Y direction.

In a state prior to performing bending thereon, the pressing portions 92 illustrated in FIG. 7 configure plate shaped portions that extend along the Y direction in a linear shape from end portions of the intermediate portions 84 on the opposite side to the coupling portions 86, these also being end portions on the side closer to the shield portions 82. Bending is then performed on the pressing portions 92 using processing equipment, not illustrated in the drawings.

As illustrated in FIG. 9, each of the pressing portions 92 is configured including a support portion 93, an elastic portion 94, and the contact portion 95. As viewed in the X direction, the support portion 93 extends toward a Y direction inner side substantially parallel to the coupling portion 86. The elastic portion 94 is formed in an inverted U shape open toward the −Z side. One end portion of the elastic portion 94 is linked to the support portion 93. Another end portion of the elastic portion 94 is linked to the contact portion 95. The contact portion 95 is bent into a peaked shape so as to project toward the opposite side to the support portion 93.

As illustrated in FIG. 13, when the plug connector 12 is being connected to the socket connector 10, the pressing portions 92 contact the projection portions 24 of the plug connector 12 and thereafter contact the terminal faces 28A of the plug connector 12, such that a Y direction pressing force acts on the plug connector 12.

Attachment Portions

In a state prior to performing bending thereon, the attachment portions 96 illustrated in FIG. 7 configure plate shaped portions that extend along the Y direction in a linear shape from end portions of the intermediate portions 84 on the opposite side to the coupling portions 86, these also being end portions on the opposite side of the pressing portions 92 to the shield portions 82. A widened portion 96A that widens toward the corresponding pressing portion 92 is formed at a leading end side of each of the attachment portions 96. An X direction size of the widened portion 96A is a size allowing press-insertion into the corresponding attachment hole 48 (see FIG. 3).

Auxiliary Shield Portions

Two of the four auxiliary shield portions 98 are disposed on the X side of the shield member 80, and two of the four auxiliary shield portions 98 are disposed on the −X side of the shield member 80. In a state prior to performing bending thereon, the auxiliary shield portions 98 on the X side and on the −X side are disposed with line symmetry to each other about a non-illustrated axis of symmetry extending along the Y direction at the X direction central position. Moreover, the auxiliary shield portions 98 on the Y side and on the −Y side are disposed with line symmetry to each other about a non-illustrated axis of symmetry extending along the X direction at the Y direction central position.

In a state prior to performing bending thereon, each of the auxiliary shield portions 98 includes an arm portion 98A that extends along the X direction from an end portion on an intermediate portion 84 side of the corresponding attachment portion 96 toward the opposite side to the pressing portion 92, and a flat plate portion 98B that is linked to an X direction end portion of the arm portion 98A. The arm portion 98A is aligned with the corresponding leg portion 88 in the Y direction. The flat plate portion 98B is formed in a substantially square shape. A plate thickness of the flat plate portion 98B is a thickness enabling insertion into the corresponding space 63 (see FIG. 5). The auxiliary shield portions 98 are integrally formed to the shield member 80, and have a function of suppressing propagation of electromagnetic waves.

Assembly of Socket Connector

From the opened-out state illustrated in FIG. 7, locations between the intermediate portions 84 and the coupling portions 86 are bent, such that the shield portions 82, the pressing portions 92, the attachment portions 96, and the auxiliary shield portions 98 upstand in the Z direction. Bending is also performed on the pressing portions 92. The auxiliary shield portions 98 are also bent so as to overlap the coupling portions 86 in the Z direction. The leg portions 88 are each bent into a crank shape. The shield member 80 illustrated in FIG. 6 is formed in this manner.

As illustrated in FIG. 8, when the shield member 80 is viewed in the Z direction, the attachment portions 96 are provided between the pressing portions 92 and the auxiliary shield portions 98 of the shield member 80. The attachment portions 96 extend along the Z direction, and are attached to the jutting-out portions 46 (see FIG. 3) by press-insertion into the attachment holes 48 (see FIG. 3) in the housing 30. The auxiliary shield portions 98 are disposed so as to overlap X direction inner side end portions of the plates 86C in the Z direction. The auxiliary shield portions 98 are each disposed lying in a Y-Z plane. The pressing portions 92 are disposed running along the Y direction at an X direction inner side of the auxiliary shield portions 98.

As illustrated in FIG. 9, when the shield member 80 is viewed in the X direction, two of the auxiliary shield portions 98 are aligned with a gap between each other in the Y direction. The Y direction gap between the two auxiliary shield portions 98 is wider than a Y direction width of the dividing wall 64 (see FIG. 11). The two auxiliary shield portions 98 cover the corresponding support portions 93 and contact portions 95 as viewed from an X direction outer side. The elastic portions 94 are exposed at the Z side of the auxiliary shield portions 98. The two contact portions 95 are disposed opposing each other in the Y direction.

Figure 10:
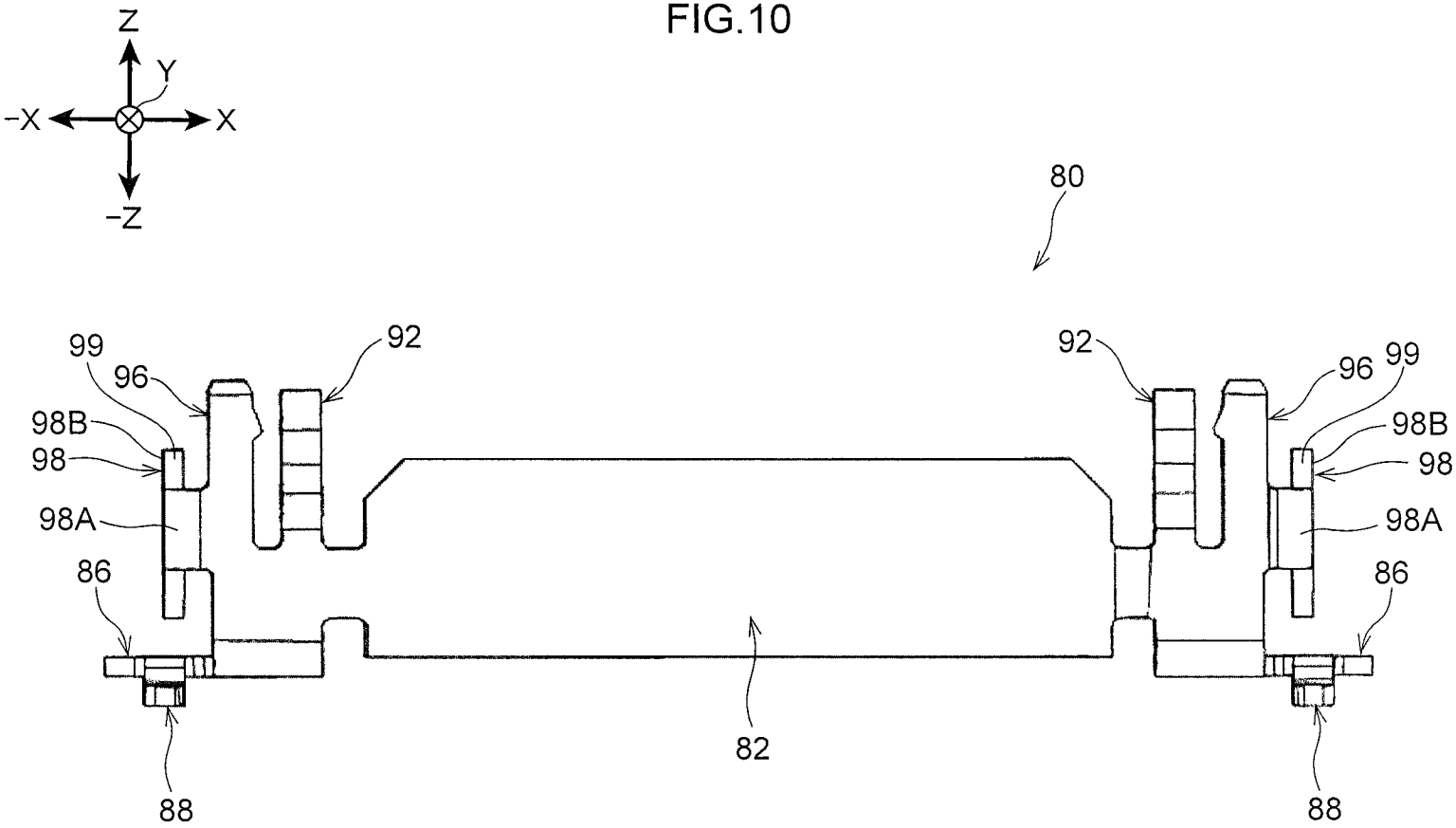
FIG. 10 is a side view at a side of a shield portion of the shield member according to the present exemplary embodiment.

As illustrated in FIG. 10, when the shield member 80 is viewed in the Y direction, the shield portions 82, the pressing portions 92, the attachment portions 96, and the auxiliary shield portions 98 are disposed in this sequence from the X direction inner side toward the outer sides. A Z direction height of end portions of the attachment portions 96 is higher than that of end portions of the pressing portions 92. Note that when the flat plate portions 98B are viewed in the X direction, a part of outer peripheral face positioned at a Y direction outer side and at a further toward the Z side than the corresponding arm portion 98A is referred to as a side face 99.

The plural terminal members 76 are attached to the housing 30 illustrated in FIG. 11. The shield member 80 is attached to the housing 30 from the −Z side. Specifically, the pressing portions 92 are inserted into the corresponding passages 44, and the auxiliary shield portions 98 are inserted into the corresponding spaces 63. The widened portions 96A (see FIG. 7) of the attachment portions 96 are then press-fitted into the attachment holes 48 to attach the shield member 80 to the housing 30, thereby completing the socket connector 10.

The auxiliary shield portions 98 are disposed on the Y side and the −Y side of the respective dividing walls 64 of the socket connector 10. The side faces 99 of the auxiliary shield portions 98 and the corresponding opposing faces 54 of the housing 30 thereby face each other in the Y direction. The contact portions 95 (see FIG. 9) are exposed at the inner side of the insertion-removal section 38. The shield portions 82 and the auxiliary shield portions 98 surround the plural terminal members 76 in the X direction and the Y direction. The −Z side end portions of the plural terminal members 76 and the plural leg portions 88 are soldered to the non-illustrated circuit of the first substrate 14 (see FIG. 1). The coupling portions 86 contact the corresponding lower end portions 52A (see FIG. 5).

Figure 12:
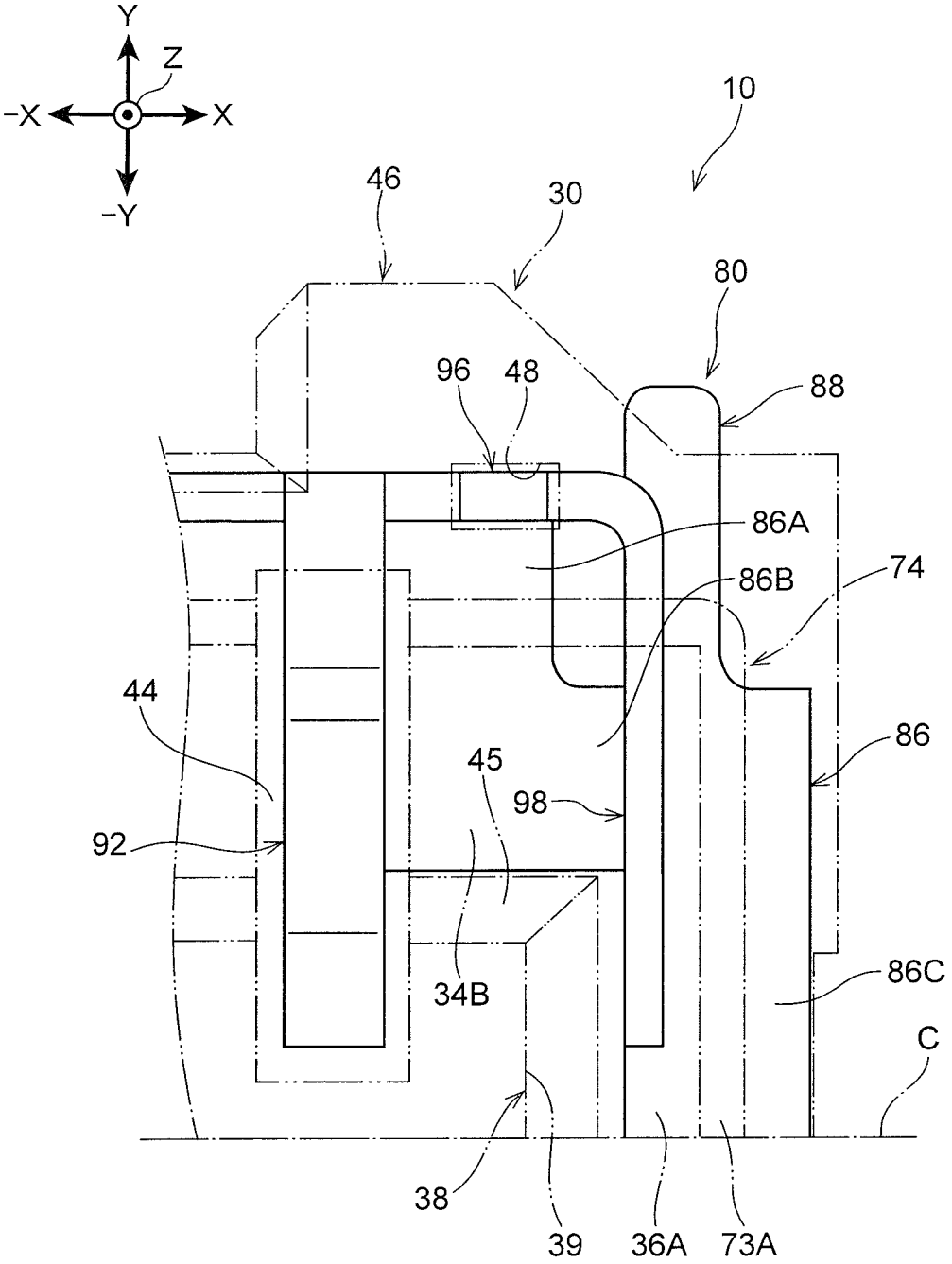
FIG. 12 is an explanatory diagram illustrating a state in which the shield member overlaps the housing according to the present exemplary embodiment as viewed in an insertion-removal direction.

FIG. 12 illustrates a state in which the shield member 80 and the housing 30 are viewed in the Z direction. Note that in FIG. 12, the outer profile of the shield member 80 is illustrated by solid lines, and the outer profile of the housing 30 is illustrated by double-dotted dashed lines. The single-dotted dashed line C represents a Y direction central position of the socket connector 10.

When the coupling portions 86 in the socket connector 10 are viewed in the Z direction, the coupling portions 86 partially overlap the corresponding guide face 74. Specifically, the plate 86A and the plate 86B overlap a part of the guide face 74 extending along the X direction. The plate 86C overlaps a part of the guide face 74 extending along the Y direction. The plate 86C also overlaps the corresponding auxiliary shield portion 98 in the Z direction.

Operation and Advantageous Effects

Explanation follows regarding operation and advantageous effects of the socket connector 10 of the present exemplary embodiment.

The plug connector 12 (see FIG. 2) is inserted into the insertion-removal section 38 of the socket connector 10 illustrated in FIG. 1. When an attempt is made to insert the plug connector 12 into the insertion-removal port 39 with the plug connector 12 offset toward the X side or the Y side, the upstanding section 21 (see FIG. 2) of the plug connector 12 contacts the guide faces 74, and the plug connector 12 is thereby guided toward the insertion-removal port 39. The socket connector 10 and the plug connector 12 are then connected together.

In the socket connector 10, the coupling portions 86 of the shield member 80 contact the lower end portions 52A, such that the coupling portions 86 are not disposed on the insertion-removal port 39 side of the housing 30. There is accordingly no need to set a placement space for the coupling portions 86 so as to be offset toward the X direction outer sides with respect to the guide faces 74.

Furthermore, as illustrated in FIG. 12, the coupling portions 86 are disposed so as to at least partially overlap the corresponding guide face 74 as viewed in the Z direction. This suppresses an increase in the X direction length of the housing compared to configurations in which the guide faces 74 and the coupling portions 86 are disposed so as not to overlap each other. As explained above, the socket connector 10 is capable of guiding the plug connector 12, and also enables an increase in the X direction size of the housing 30 to be suppressed.

As illustrated in FIG. 11, in the socket connector 10 the auxiliary shield portions 98 are added to the pair of shield portions 82, thereby enabling a range in which the propagation of electromagnetic waves is suppressed in the socket connector 10 to be enlarged. Furthermore, the auxiliary shield portions 98 are disposed so as to at least partially overlap the coupling portions 86 and the guide faces 74 as viewed in the Z direction. This suppresses an increase in the X direction length of the housing 30 compared to configurations in which the auxiliary shield portions 98 are disposed so as not to overlap the coupling portions 86 and the guide faces 74 in the Z direction. This thereby enables an increase in the X direction size of the socket connector 10 to be suppressed.

As illustrated in FIG. 13, when the plug connector 12 is inserted into (connected to) the insertion-removal section 38 (see FIG. 1) of the socket connector 10, the projection portions 24 contact the contact portions 95 of the pressing portions 92, such that the elastic portions 94 undergo elastic deformation. Thus, when the projection portions 24 move toward the −Z side after passing beyond the contact portions 95, the contact portions 95 and the terminal faces 28A contact each other. Note that the auxiliary projection portions 29 project out at a Z side of the terminal faces 28A, thereby restricting over-insertion of the plug connector 12.

Note that when external force in a removal direction acts on the plug connector 12, the contact portions 95 and the projection portions 24 contact each other, such that movement of the plug connector 12 toward the Z side is temporarily restricted. This restriction continues until the external force acting on the plug connector 12 exceeds a preset external force. Namely, movement of the plug connector 12 is temporarily restricted by the contact between the contact portions 95 and the projection portions 24, thereby enabling unintended removal of the plug connector 12 connected to the socket connector 10 to be suppressed.

Explanation follows regarding a case in which the plug connector 12 has been connected to (inserted into) the socket connector 10. As illustrated by the arrow Y1 in FIG. 14, the intermediate portions 84 are displaced toward the Y direction outer sides by a force F (an external force) acting on the pressing portions 92. The auxiliary shield portions 98 that are linked to the intermediate portions 84 are also displaced toward the Y direction outer sides as illustrated by the arrow Y2. Note that in FIG. 14, only the force F acting toward the −Y side is illustrated, and the force F acting toward the Y side is omitted from illustration.

Note that as illustrated in FIG. 11, when the auxiliary shield portions 98 are displaced toward both outer sides in the Y direction, the opposing faces 54 contact the side faces 99 of the auxiliary shield portions 98, such that the restriction portions 50 of the socket connector 10 restrict displacement of the auxiliary shield portions 98 in the Y direction. This enables the auxiliary shield portions 98 to be suppressed from coming apart from the housing 30 more effectively than in configurations in which the restriction portions 50 are not provided.

Moreover, in the socket connector 10, displacement of the auxiliary shield portions 98 can be restricted simply, by forming the opposing faces 54 to the housing 30. This enables an increase in the number of members to be suppressed compared to configurations in which the restriction portions 50 are provided to the housing 30 as separate members that are distinct from the housing 30.

Furthermore, in the socket connector 10, the upright walls 52 (see FIG. 5) and the auxiliary shield portions 98 contact each other in a state in which the auxiliary shield portions 98 are displaced (rotated) in an X-Y plane with respect to the intermediate portions 84. This enables rotational movement of the auxiliary shield portions 98 with respect to an axial direction in the Z direction (movement of the auxiliary shield portions 98 in the X direction) to be restricted. In addition thereto, the auxiliary shield portions 98 are covered by the upright wall 52 as viewed in the X direction, such that the auxiliary shield portions 98 are not exposed to the outside of the housing 30. This restricts contact between the auxiliary shield portions 98 and other members or the hands of an operator, thereby enabling deformation of the auxiliary shield portions 98 to be suppressed.

Figure 14:
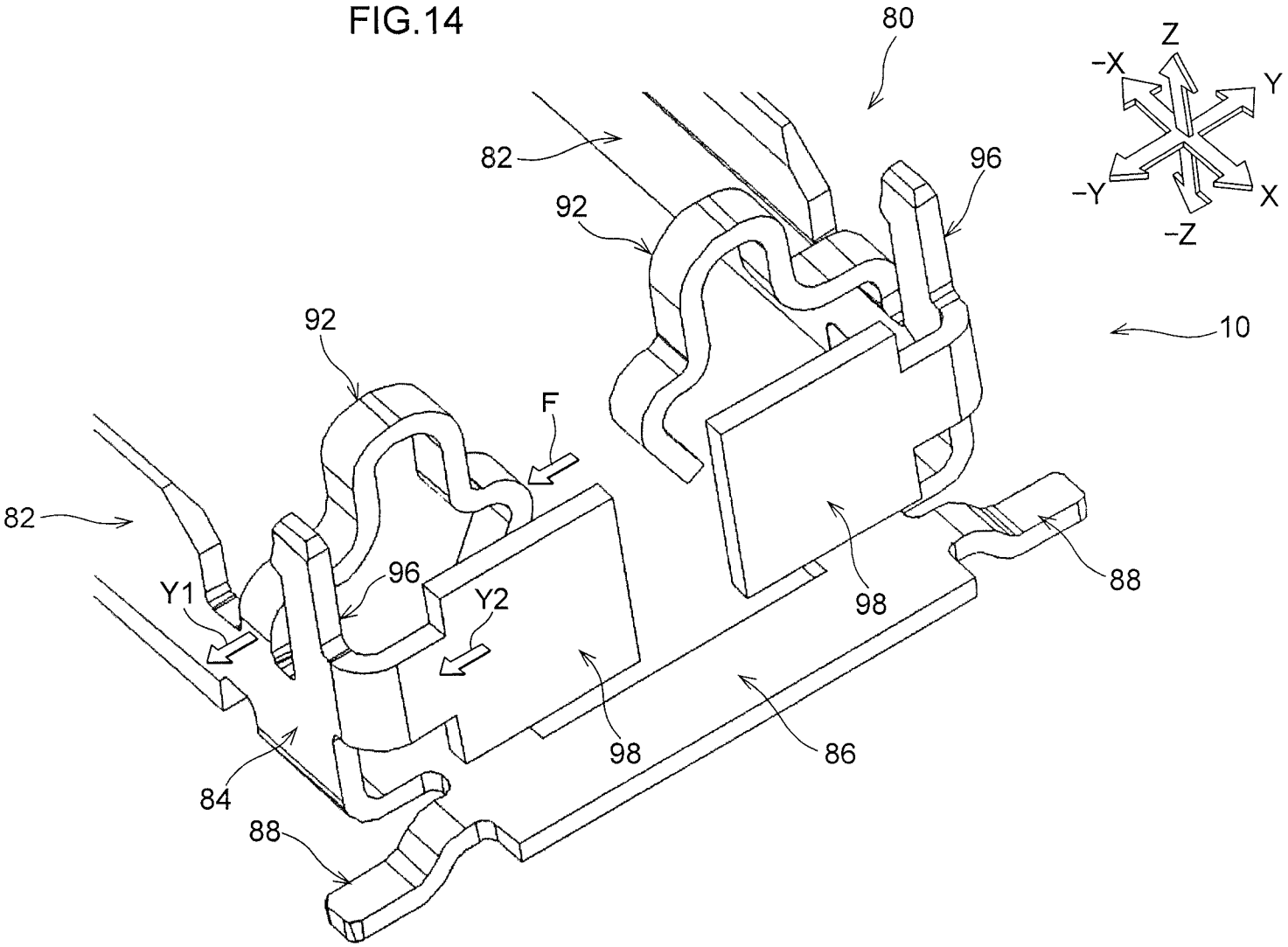
FIG. 14 is an explanatory diagram illustrating a state in which force is acting on the pressing portions according to the present exemplary embodiment.

As illustrated in FIG. 14, in the socket connector 10 rigidity of the intermediate portions 84 of the shield member 80 with respect to force from the pressing portions 92 toward the auxiliary shield portions 98 is increased by the attachment portions 96 provided between the pressing portions 92 and the auxiliary shield portions 98. This enables displacement of the auxiliary shield portions 98 due to displacement of the pressing portions 92 when the plug connector 12 (see FIG. 2) has been connected to the socket connector 10 to be more effectively suppressed than in configurations in which the attachment portions 96 are not provided between the pressing portions 92 and the auxiliary shield portions 98.

Note that the present disclosure is not limited to the above exemplary embodiment.

In the socket connector 10, the auxiliary shield portions 98 do not have to at least partially overlap the coupling portions 86 and the guide faces 74 as viewed in the Z direction. The socket connector 10 may be configured without providing the restriction sections 50. The restriction sections 50 are not limited to the opposing faces 54 formed to the housing 30, and may be configured by another member provided at the housing 30. The opposing faces 54 are not limited to planar faces, and may be curved faces. The opposing faces 54 may be provided at the upright walls 52. The restriction sections 50 may be configured without the upright walls 52.

The plug connector 12 may be configured without the projection portions 24. A configuration may be applied in which the pressing portions 92 are not provided to the shield member 80. The plug connector 12 may be pressed by a different member to the shield member 80. A configuration may be applied in which the attachment portions 96 are not provided between the pressing portions 92 and the auxiliary shield portions 98. For example, a configuration may be applied in which the attachment portions 96 are provided at the shield portions 82.

The respective numbers of shield portions 82, intermediate portions 84, coupling portions 86, leg portions 88, pressing portions 92, attachment portions 96, and auxiliary shield portions 98 may differ from those in the above exemplary embodiment. The attachment method of the attachment portions 96 to the housing 30 is not limited to press-fitting of the widened portions 96A. A method using an adhesive, a method using fasteners such as screws, or an insert-molding method in which the housing 30 and the shield member 80 are molded as an integral unit, may be applied.

What is claimed is:

1. A connector comprising: a housing and a shield member, the housing comprising an insertion-removal section and a guide face, a connection target, from an insertion-removal side thereof, being inserted into or removed from the insertion-removal section through an insertion-removal port in an insertion-removal direction, and the guide face formed at a peripheral portion of the insertion-removal section such that the guide face is configured to guide the connection target toward the insertion-removal section, the shield member comprising a pair of shield portions, auxiliary shield portions, and a coupling portion, the pair of shield portions disposed on both sides of the housing with respective shield surfaces thereof facing each other in a first direction that intersects the insertion-removal direction, and the pair of shield portions being extended in a second direction that intersects the insertion-removal direction and the first direction so as to suppress propagation of electromagnetic waves, the auxiliary shield portions integrated to respective ends in the second direction of the pair of shield portions and extended in the first direction, and the auxiliary shied portions suppressing propagation of electromagnetic waves, and the coupling portion coupling the pair of shield portions together in the first direction, the coupling portion contacting a location of the housing on an opposite side to the insertion-removal port in the insertion-removal direction, and the coupling portion being disposed so as to at least partially overlap the guide face and the auxiliary shield portions as viewed in the insertion-removal direction.

2. The connector of claim 1, wherein the housing is provided with a restriction section that restricts displacement of the auxiliary shield portion in the second direction.

3. The connector of claim 2, wherein the restriction section includes a contact face that is capable of contacting the auxiliary shield portion.

4. The connector of claim 2, wherein the restriction section includes a side wall that covers the auxiliary shield portion as viewed in the second direction, the second direction being orthogonal to both the insertion-removal direction and the first direction.

5. The connector of claim 3, wherein the restriction section includes a side wall that covers the auxiliary shield portion as viewed in the second direction, the second direction being orthogonal to both the insertion-removal direction and the first direction.

6. The connector of claim 1, wherein:

the connection target includes a body with a terminal face that is exposed in the first direction, and a projection portion that is formed further toward the insertion-removal side in the insertion-removal direction of the body than the terminal face, and the projection portion projects in the first direction; and the shield member is provided with a pressing portion that is disposed further toward an inner side than the auxiliary shield portion, the pressing portion being capable of elastic deformation, the pressing portion is configured so as to contact the projection portion of the connection target and thereafter to contact the terminal face of the connection target to apply a pressing force to the connection target, in a case in which the connection target is inserted through the insertion-removal port of the housing.

7. The connector of claim 6, wherein:

an attachment site is formed at the housing; and an attachment portion that extends in the insertion-removal direction, for attachment to the attachment site, is provided between the pressing portion and the auxiliary shield portion of the shield member.

* * * * *